US006145765A

United States Patent [19]

Capelle, Jr. et al.

[11] Patent Number: 6,145,765

[45] Date of Patent: Nov. 14, 2000

[54] FLUID ENERGY MILL

[75] Inventors: William Edward Capelle, Jr., Gulfport, Miss.; John Donald Connolly, Jr.; Stephan Claude De La Veaux, both of Wilmington, Del.; Ana Estela Diaz, Chadds Ford, Pa.; John Phillip Lanci, Sr., Long Beach, Miss.; George Alan Schurr, Newark, Del.

[73] Assignee: E. I. du Pont de Nemours and Company, Wilmington, Del.

[21] Appl. No.: 08/971,537

[22] Filed: Nov. 17, 1997

Related U.S. Application Data

[63] Continuation-in-part of application No. 08/612,737, Mar. 8, 1996, abandoned.

[51] Int. Cl.[7] ..... B02C 19/06

[52] U.S. Cl. ..... 241/5; 241/39

[58] Field of Search ..... 241/5, 39, 40

[56] References Cited

U.S. PATENT DOCUMENTS

| | | | |
|---|---|---|---|
| 2,032,827 | 3/1936 | Andrews . | |
| 2,562,753 | 7/1951 | Trost | 241/39 |
| 3,425,638 | 2/1969 | Doyle et al. | 241/39 |
| 3,462,086 | 8/1969 | Bertrand et al. | 241/5 |
| 3,726,484 | 4/1973 | Schurr | 241/5 |
| 4,056,233 | 11/1977 | Fay | 241/39 |
| 4,198,004 | 4/1980 | Albus et al. | 241/39 |
| 4,219,164 | 8/1980 | Taylor | 241/5 |
| 4,280,664 | 7/1981 | Jackson et al. | 241/39 |
| 4,451,005 | 5/1984 | Urayama | 241/40 |

FOREIGN PATENT DOCUMENTS

| | | |
|---|---|---|
| 627858 | 10/1978 | Russian Federation . |
| 946663 | 7/1983 | Russian Federation . |
| 1 362 373 | 8/1974 | United Kingdom . |

*Primary Examiner*—Mark Rosenbaum

[57] ABSTRACT

An improved fluid energy mill having a curved-shaped insert having a leading edge and a trailing edge with an azimuthal angle of between 10° and 300° and a positive or zero angle of attack is disclosed. This mill provides for lower energy consumption while improving or maintaining product specifications, and improved production rates.

8 Claims, 1 Drawing Sheet

FLUID ENERGY MILL

CROSS-REFERENCE TO RELATED APPLICATIONS

This application is a continuation-in-part of U.S. patent application Ser. No. 08/612,737 having a filing date of Mar. 8, 1996, now abandoned.

BACKGROUND OF THE INVENTION

The present invention relates to fluid energy mills, in particular, to an improved fluid energy mill which is provided with a fluid dynamic control insert that maintains or improves the quality of the milled product at lower energy consumption and at lower cost of operation.

Fluid energy mills of a vortex type are well known and widely employed in certain industries because of their efficiency and economy in comminution of particulate solids. A number of early designs are described in considerable detail in Andrews, U.S. Pat. No. 2,032,827. These mills generally comprise a disc-shaped zone wherein an inward circular or spiral flow of the gaseous fluid causes attrition of the particles at the periphery and provides a size separation in an intermediate zone. The mill combines the function of grinding and classification within a single chamber. Since the fluid is fed into the periphery and discharged at the axis of a vortex, there is a tendency for particles to be swept toward the central outlet in a spiral path. The force due to drag of the fluid acting on the suspended particle is opposed by the centrifugal force. This balance of forces can be so adjusted that coarse particles tend to return to or be held at the periphery for more attrition while smaller particles are swept to the center for collection in a cyclone and/or filters. In these mills, the energy for comminution is supplied in a gaseous fluid medium injected tangentially into the vortex chamber to create and maintain the vortex.

Attempts to prevent premature escape of larger particles from the mill or to avoid energy loss have been described in the literature. For example, Doyle and Becker, U.S. Pat. No. 3,425,638 describe a fluid energy mill having a cylindrical baffle being closed at one end and having a plurality of passageways on the cylinder surface. Taylor, U.S. Pat. No. 4,219,164 describes a fluid energy mill with an upwardly flowing vortex having a circular annulus. Although various modifications of the above-described mills have been proposed, none has proven to be wholly satisfactory and further improvements are desirable.

Trost, U.S. Pat. No. 2,562,753 discloses a fluid energy mill which has a plurality of restrictors positioned within the mill such that the restrictors are adjacent to and in line with the grinding fluid jets. The restrictors are located such that a confined passageway is created, wherein and whereby material is forced closer to the jets to increase the cutting action of the jets upon the particles of the material. Thus, these restrictors have a negative angle of attack which is further discussed below. The fluid from the jets deflects some of the material against the restrictors which results in some abrasion of the material. It is suggested that this mill can be used to grind materials such as powdered milk, cocoa, stock feed and instant coffee.

In the white pigment industry, there is a particular need to reduce the amount of oversized material passing prematurely into the resulting pigment product. Thus, the intensity of grinding is typically increased with resultant greater costs in terms of fluid use, energy consumption, and reduced capacity per nill. Further, with such processes, the amount of oversized material may be reduced, but there may be adverse effects on pigment properties. Further enhancement in grinding efficiency is needed. Concomitantly, there is a need to achieve a longer life of the inner wear liners typically used within these mills. The present invention meets these needs.

SUMMARY OF THE INVENTION

In accordance with this invention, there is provided in a fluid energy mill of a vortex type for comminuting pulverulent materials having in combination,

- a disc-shaped grinding chamber defined by a pair of opposing circular-shaped axial walls and a peripheral wall,
- a multiplicity of jets extending through the peripheral wall for injecting gaseous fluid into the chamber,
- an inlet for introducing pulverulent material into the chamber, and
- an outlet along the axis of the chamber for withdrawing the pulverulent material and gaseous fluid from the chamber, the improvement comprising:
  - (a) a curved-shaped insert having an azimuthal angle between about 10° and about 300°; a leading edge and a trailing edge, wherein the leading edge is positioned upstream of, downstream of, or at the inlet for introducing the pulverulent material; and a positive or zero angle of attack to alter the pressure of the gaseous fluid in the region of the inlet; and
  - (b) a means for mounting the insert in the grinding chamber, wherein the insert is operatively attached to the chamber.

The insert preferably has an airfoil shape and is rigidly fixed within the disc-shaped grinding chamber. Preferably, the insert has an azimuthal angle of between about 60° and about 180°, and more preferably between about 90° and about 140°. Preferably, the pulverulent material is titanium dioxide pigment.

The insert is preferably constructed from hard and wear resistant materials such as stainless steel, hardfaced stainless steel, 440 stainless steel, cast iron and ceramic. Examples of suitable ceramics include metal compounds of borides, carbides, nitrides and mixtures thereof.

In one preferred embodiment, the curved-shaped insert is constructed of stainless steel and is mounted with a radial arm pinned in the center of the grinding chamber. The azimuthal angle of the insert is between about 90° and 140°. The leading edge of the insert is positioned upstream of the feed inlet and has a positive angle of attack between about 0° and 45°.

This invention also encompasses a process for grinding titanium dioxide pigment in the fluid energy mill described above. This process involves introducing the pigment into the grinding chamber and grinding the pigment to provide a ground pigment product.

DETAILED DESCRIPTION OF THE INVENTION

Figure 1:
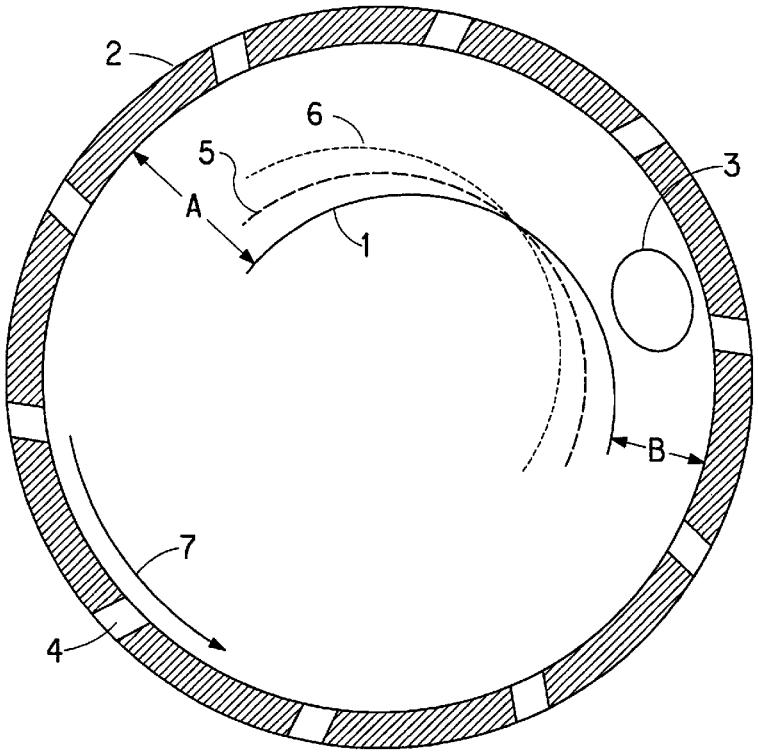
FIG. 1 is a horizontal cross section view of a fluid energy mill embodying this invention.

Most fluid energy mills are variations on a basic configuration of a disc-shaped chamber enclosed by two generally parallel circular plates defining axial walls and an annular rim defining a peripheral wall, the axial length or height of the chamber being substantially less than the diameter of the chamber. Around the circumference of the mill are located a number of uniformly spaced jets for injecting the gaseous fluid which furnishes the energy for comminution. The jets are oriented such that the gaseous fluid and pulverulent material, i. e. feed material to be ground and classified, are injected tangentially to the circumference of a circle smaller than the chamber circumference. There are also one or more inlets for introducing (feeding) the pulverulent material. There may be motive fluid present with the pulverulent material as it is introduced into the chamber. An outlet, e.g., a conduit, is provided along the axis of the chamber for withdrawing the pulverulent material and gaseous fluid from the chamber. The comminuted material can be discharged to a cyclone and/or filter for collection.

The fluid energy mill of this invention can be any fluid energy mill as known in the art of the vortex type, having either a top or bottom outlet, and having an aerodynamically-shaped insert positioned within the grinding chamber as described hereinbelow. A particularly preferred base mill with no insert is described in Schurr, U.S. Pat. No. 3,726,484, the teachings of which are incorporated herein by reference.

The improved fluid energy mill of this invention has a curved-shaped insert. It should be recognized that the curved-shape of the insert is based on well established aerodynamic principles. The insert can optionally have slats. The insert does not need to be smooth and continuous. The insert can be a series of pins defining a curve or a series of flat or curved shapes defining a curve. In a preferred embodiment, the insert has an airfoil shape. The curved-shape of the insert is designed to minimize erosion resulting from particle impact of the pulverulent material against the insert.

Materials of construction of the insert can vary, and are typically hard and wear resistant. Examples include but are not limited to stainless steel, hardfaced stainless steel, 440 stainless steel, white cast iron, or ceramics comprising metal compounds of oxides, borides, carbides, nitrides and mixtures thereof. The insert is preferably constructed of a ceramic or a mixture of ceramics such as silicon carbide, silicon nitride, aluminum oxide or the like.

The insert has an azimuthal angle or span ranging from about 10° and 300°, preferably between about 60° and 180°, and most preferably between about 90° and 140°. The "azimuthal angle" is defined herein as the angle between a leading edge and a trailing edge of the insert, i.e., an arc of a horizon measured between a fixed point and a vertical circle passing through the center. "Leading edge" is used herein to refer to the foremost portion of the insert preceding the rotational flow of the incoming fluid stream from the jets. "Trailing edge" is used herein to refer to the rearmost portion of the insert preceding the rotational flow of the incoming fluid stream. The insert is located such that the leading edge is upstream of, downstream of, or at the inlet for introducing the pulverulent material, i.e., feed inlet or feed tube. A preferred distance of the feed inlet is within about 10° of the leading edge. Preferably, the leading edge is upstream of the feed inlet, i. e., the leading edge precedes the feed inlet. The feed inlet can provide introduction of the feed pulverulent material into the top, side, or bottom of the chamber. One or more feed inlets are contemplated.

The insert has a positive or zero angle of attack. "Angle of attack" is defined herein as an arctan of the distance of the trailing edge of the insert from the peripheral wall minus the distance of the leading edge of the insert from the peripheral wall, divided by a chord length. The chord length is the distance between the leading edge and the trailing edge. The preferred angle of attack is positive and may range from 0° to 45°, and more preferably 0° to 20°, and most preferably 0° to 10°.

It has been surprisingly found that with a positive or zero angle of attack, there is a dramatic improvement in feed vacuum, i.e., a higher feed vacuum allows more pulverulent material to be introduced into the grinding chamber, or allows for substantially less motive fluid for transporting the pulverulent material through the feed inlet and into the grinding chamber.

It has also been found that when the angle of attack is negative, which is outside the scope of this invention, a positive pressure is induced in the grinding chamber in the vicinity of the feed inlet, creating a pressure barrier to incoming feed material and reducing the rate at which the material can be introduced into the chamber. The negative angle of attack leads to a corresponding increase in fluid pressure. Thus, a high pressure region would be created inside of the insert, i.e., towards the jets, while a lower pressure region would be created outside of the insert, i.e., radially towards the center of the grinding chamber.

In contrast, with a positive or zero angle of attack, a low pressure region is created inside of the insert and a higher pressure region is created outside of the insert. This lower pressure region is located in the vicinity of the feed inlet and removes the pressure barrier that the feed inlet must act against in order to deliver the pulverulent material into the grinding chamber.

In addition, the flow fields of the gaseous stream over the insert which develop during generation of the low pressure region inside of the insert are of sufficient intensity that the incoming feed stream of pulverulent material follows the flow fields and does not substantially interact with the insert. While it is recognized that there may be some minor contact between the particles of the material and the leading edge of the insert, this contact is minimal.

The distance of the insert from the peripheral wall, as measured from the leading or trailing edge, is about 10 to 60% and, preferably 30 to 40%, of the radius of the grinding chamber. The distance of the insert from the peripheral wall should be such that it is always radially inward of the inner edge, or inner edge of the orthogonal extension, of the feed inlet, thereby encasing the entering feed material for a defined azimuthal distance. The insert is positioned sufficiently radially distant from the peripheral wall such that the insert is unaffected by the fluid being emitted from the jets. The insert should be so positioned to prevent extensive wear on the insert, especially when the particulate solid to be ground is a relatively hard material such as pigmentary titanium dioxide.

The insert can be placed within the grinding chamber such that it is angled or perpendicular relative to the top or bottom of the chamber. Preferably, the insert is perpendicular to the bottom of the chamber. The insert may be secured in place at some fixed point within or outside the chamber, for example, the insert can be fixed by attachment to an outer housing or to the inner lining.

The insert can be mounted in any fashion within the mill such that the insert is physically held within the grinding chamber. The insert can be rigidly fixed in place or can be positioned such that it is capable of movement such as oscillation about the angle of attack, while the mill is in operation. Preferably, the insert is rigidly fixed in place. The means for mounting the insert is not especially critical and will depend upon materials of construction and operating parameters of the mill. For example, an adhesive, compression between the top and bottom axial walls, or struts can be used to mount the insert to a center pin, or struts can be used to mount the insert to the top or bottom of the mill or mill housing. The struts may or may not be movable.

Alternatively, the insert can also be directly bonded to the liner of the mill by means such as bonding or as casting the insert as part of the liner or mounting the insert to the liner. Still other possible means for mounting the insert within the mill can be through a radial arm that may be movable, e.g., via cylinder or screw, to allow rotation of the insert around the grinding chamber for adjustment of operating conditions. A radial arm mount for the insert can also provide means to pivot the insert, providing the capability of varying the angle of attack. Other means for mounting the insert within the mill will be apparent to one skilled in the art using the preceding description and utilizing the present invention to its fullest extent.

In the operation of a fluid energy mill of this invention, any carrier gas can be used as the fluid, such as nitrogen, compressed air, helium, steam, $CO_2$, steam under pressure, and superheated steam, if desired. Other vapors or gases may be selected for use primarily on the basis of compatibility with the material being processed and provided the materials involved are not degraded by contact with the carrier gas. The pulverulent material can be any solid material, inorganic or organic. Inorganic materials can be, for example, metal oxides, such as titanium dioxide pigment, ceramics, and minerals. Organic materials can be, for example, pharmaceuticals or coal.

The present invention provides an improved fluid energy mill having an insert positioned inside of the grinding chamber such that it partially blocks a mean free path of the gaseous fluid and ground particles as they attempt to exit the grinding chamber. The insert redefines the grinding fluid (gaseous fluid plus feed material particles) flow direction in the vicinity of the feed inlet, and the absolute pressure regions established within the chamber. It is believed the insert is not only a physical barrier to undesirable pathways of partially ground particles, but it is also a fluid dynamic device that directly alters the velocity, mean free path, and absolute pressure of the grinding fluid in localized regions of the grinding chamber resulting in previously unknown control of the operating parameters of a fluid energy mill.

Referring now to the drawings, like reference numerals and reference characters have the same significance. FIG. 1 is a schematic horizontal cross section view of a fluid energy mill of this invention. Insert (1) is a curved shape showing a positive angle of attack, having distance (A) of the trailing edge from the peripheral wall greater than distance (B) of the leading edge from the peripheral wall. Mill inner wear liner (2) provides the peripheral wall. Inlet opening (3) provides for introduction of pulverulent material through the top of the mill cover. Jets (4) in mill inner wear liner (2) provide for introduction of fluid into the grinding chamber. A multiplicity of jets (4) is preferred. Insert (5) shows an alternative location for the insert, at a zero angle of attack [distance (A) is equal to distance (3)]. Insert (6) shows the insert at a negative angle of attack [distance (A) is less than distance (B)], which is outside the scope of this invention. The direction of internal fluid flow (7) is also shown in FIG. 1.

Figure 2:
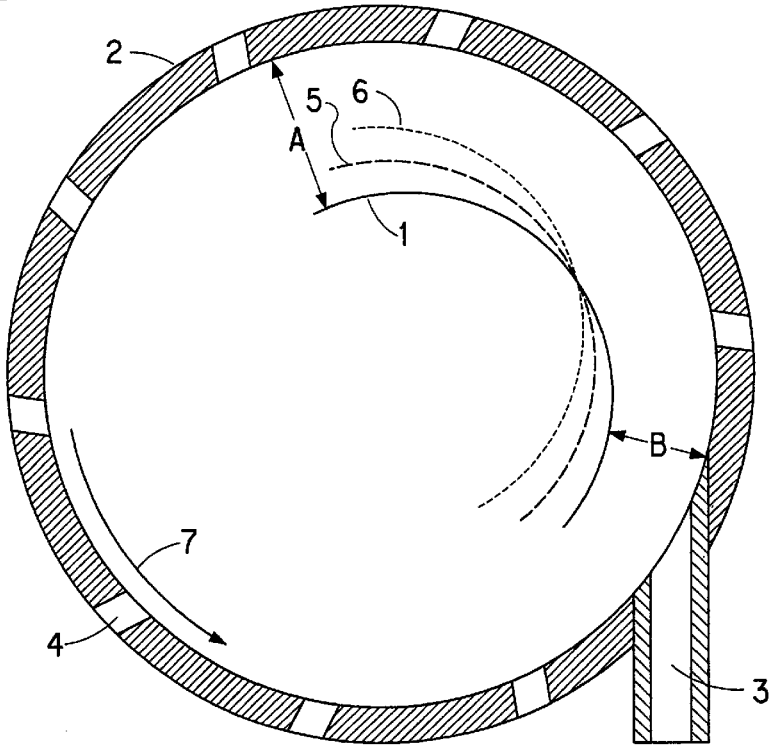
FIG. 2 is a horizontal cross section view setting forth an alternative embodiment of this invention.

FIG. 2 is a schematic horizontal cross section view of a fluid energy mill of this invention. FIG. 2 differs from FIG. 1 with respect to the feed inlet (3). Inlet (3) in FIG. 2 provides for introduction of feed material through a side opening in the mill inner wear liner (2).

The fluid energy mill of this invention is characterized by the following advantages which cumulatively render it preferable to those mills currently available:

1. lowers total energy consumption in excess of at least 10% while maintaining or improving resulting product specifications;
2. increases production rate;
3. improves classification in the grinding zone, thus narrowing the particle size distribution of the pulverulent material;
4. increases the life of mill liners; and
5. increases the control over the operation of the mill, which provides much greater uniformity of the product.

It will be appreciated that the insert is functional over a wide range of azimuthal angles, i.e., lengths of grinding chamber blocked by the insert, positions within the grinding chamber, and operating conditions. To give a clearer understanding of the invention, the following Example is construed as illustrative and not limitative of the underlying principles of the invention in any way whatsoever.

EXAMPLE

An airfoil-shaped insert constructed of stainless steel having an azimuthal angle of 120° and a positive angle of attack of 5° was mounted with a radial arm pinned in the center of a fluid energy mill of the vortex type creating an "L" cross section. The insert was pinned such that it was held rigidly in place. This apparatus was tested in a commercial plant and five $TiO_2$ pigments were tested. Also, five $TiO_2$ pigments were tested without the presence of the insert (Control). The resulting pigment products from the mill with and without the insert were compared. A practical method of evaluating the mill action was used, i.e., measurement of gloss and particle size for $TiO_2$ pigment used for coatings applications (Table 1), and screen and particle size for $TiO_2$ pigment used for plastics applications (Table 2). Steam to pigment rates and feed rates were also measured.

TABLE 1

(Coating Grades of $TiO_2$)

| | Insert | Control |
|---|---|---|
| Gloss | 68–76 | 67–76 |
| % > 0.6 | 6–16 | 5–16 |
| S/P ratio | 20–45% less stream | |
| Feed rate | 4–26% more rate | |

(Values are provided as range of test results.)

TABLE 2

(Plastics Grades of $TiO_2$)

| | Insert | Control |
|---|---|---|
| Screen | 11 | 11 |
| % >0.6 | 8 | 8 |
| S/P ratio | 30% less steam | |
| Feed rate | 9% more rate | |

The use of the insert in the fluid energy mill reduced the quantity of steam required to grind the pigments and provided improved or comparable quality of the resulting pigment product. For certain pigments, the feed rates were enhanced when the insert was used without detrimental effects on pigment product quality.

These tests further showed that when an insert was used, the liner was still functional at a lifetime of about two to four times longer than the life expectancy of such a liner in the absence of an insert.

As used herein, Gloss is determined by formulating a pigment sample into a test paint, which is prepared by using a sandmilled dispersion of $TiO_2$ in an alkydmelamine baking system or in the case of waterborne systems by drawdowns of high speed dispersed emulsion paints, sprayed on an aluminum panel and compared with panels of known gloss values.

%>0.6 is the fraction of particles greater than 0.6 microns in size. Particle size distribution of the pigment products was measured by sedimentation analysis, with a Sedigraph® (Micromeritics Instrument Corp., Norcross, Ga.) after dispersion in suspension by fixed level sonication.

S/P ratio is the improvement in steam to pigment ratio when the insert was present in the fluid energy mill relative to the steam to pigment ratio when there was no insert present in the mill. Improvement in S/P ratio reduces the energy costs related to operating the mill and also can provide higher feed rate of pigment.

Feed rate is the increase in feed rate of pigment when the insert is present in the mill relative to the feed rate without the insert present. Increase in feed rate allows operation of the mill at higher throughput of pigment, therefore, higher production rates.

Screen is a test of dispersion. A 50 wt % concentrate of $TiO_2$/low-density polyethylene was prepared in a Banbury®-type mixer (available from Farrel Corp., Ansonia, Conn.), chopped into small granules, and extruded on Killion Extruder through a 325 mesh screen. The undispersed $TiO_2$ grit particles retained on the screen were measured on a Texas Nuclear single element analyzer. The higher the number, the poorer the dispersion of the $TiO_2$ in the plastic.

Having thus described and exemplified the invention with a certain degree of particularity, it should be appreciated that the following claims are not to be limited but are to be afforded a scope commensurate with the wording of each element of the claims and equivalents thereof.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a fluid energy mill of a vortex type for comminuting pulverulent materials having in combination, a disc-shaped grinding chamber defined by a pair of opposing circular-shaped axial walls and a peripheral wall, a multiplicity of jets extending through the peripheral wall for injecting gaseous fluid into the chamber, an inlet for introducing pulverulent material into the chamber, and an outlet along the axis of the chamber for withdrawing the pulverulent material and gaseous fluid from the chamber, the improvement comprising:

(a) a curved-shaped insert having an azimuthal angle between about 10° and about 300°; a leading edge and a trailing edge, wherein the leading edge is positioned upstream of, downstream of, or at the inlet for introducing the pulverulent material; and a positive or zero angle of attack to alter the pressure of the gaseous fluid in the region of the inlet; and (b) a means for mounting the insert in the grinding chamber, wherein the insert is operatively attached to the chamber.

2. The mill of claim 1, wherein the azimuthal angle of the insert is between about 60° and about 180°.

3. The mill of claim 2, wherein the azimuthal angle of the insert is between about 90° and about 140°.

4. The mill of claim 1, wherein the insert has an airfoil shape and a material of construction selected from the group consisting of stainless steel, hardfaced stainless steel, 440 stainless steel, cast iron and ceramic.

5. The mill of claim 4, wherein the material of construction of the insert is a ceramic selected from metal compounds of borides, carbides, nitrides and mixtures thereof.

6. The mill of claim 5, wherein the insert is rigidly fixed within the disc-shaped grinding chamber.

7. In a fluid energy mill of a vortex type for comminuting pulverulent materials having in combination, a disc-shaped grinding chamber defined by a pair of opposing circular-shaped axial walls and a peripheral wall, a multiplicity of jets extending through the peripheral wall for injecting gaseous fluid into the chamber, an inlet for introducing pulverulent material into the chamber, and an outlet along the axis of the chamber for withdrawing the pulverulent material and gaseous fluid from the chamber, the improvement comprising:

a stainless steel curved-shaped insert mounted with a radial arm pinned in the center of the chamber having an azimuthal angle of between about 90° and about 140°; a leading edge and a trailing edge, wherein the leading edge is positioned upstream of the inlet for introducing the pulverulent material; and a positive angle of attack between about 0° and about 45° to alter the pressure of the gaseous fluid in the region of the inlet.

8. A process for grinding titanium dioxide pigment in a fluid energy mill having a grinding chamber, comprising introducing the pigment into the chamber and grinding the pigment to provide a ground pigment, said chamber having:

(a) a curved-shaped insert having an azimuthal angle between about 10° and about 300°; a leading edge and a trailing edge, wherein the leading edge is positioned upstream of, downstream of, or at the inlet for introducing the pulverulent material; and a positive or zero angle of attack to alter the pressure of the gaseous fluid in the region of the inlet; and (b) a means for mounting the insert in the grinding chamber, wherein the insert is operatively attached to the chamber.

* * * * *